US010637197B2

(12) United States Patent
Oka

(10) Patent No.: US 10,637,197 B2
(45) Date of Patent: Apr. 28, 2020

(54) CONNECTOR AND WIRE HARNESS

(71) Applicant: Hitachi Metals, Ltd., Tokyo (JP)

(72) Inventor: Taichi Oka, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 15/765,380

(22) PCT Filed: Oct. 14, 2015

(86) PCT No.: PCT/JP2015/079054

§ 371 (c)(1),
(2) Date: Apr. 2, 2018

(87) PCT Pub. No.: WO2017/064772

PCT Pub. Date: Apr. 20, 2017

(65) Prior Publication Data

US 2018/0287307 A1 Oct. 4, 2018

(51) Int. Cl.

| | |
|---|---|
| ***H01R 13/648*** | (2006.01) |
| ***H01R 13/6598*** | (2011.01) |
| ***H01F 17/06*** | (2006.01) |
| ***H01R 13/7193*** | (2011.01) |
| ***H01R 13/6581*** | (2011.01) |

(Continued)

(52) U.S. Cl.

CPC ..... *H01R 13/6598* (2013.01); *H01F 17/06* (2013.01); *H01R 13/6581* (2013.01); *H01R 13/7193* (2013.01); *H01B 7/0045* (2013.01); *H01F 27/25* (2013.01); *H01F 2017/065* (2013.01); *H01R 11/12* (2013.01); *H01R 2201/26* (2013.01)

(58) Field of Classification Search

CPC ..... G01V 3/28; H01R 9/032; H01R 13/7193; H01R 27/25; H01R 2017/065; H01R 17/06; H01R 13/6581; H01R 13/6598; H01R 11/12

USPC ..... 439/607.01

See application file for complete search history.

(56) References Cited

U.S. PATENT DOCUMENTS

| | | | | |
|---|---|---|---|---|
| 9,258,933 | B2 | 2/2016 | Imahori | |
| 2003/0104727 | A1* | 6/2003 | Chen | H01R 9/032 439/607.48 |

(Continued)

FOREIGN PATENT DOCUMENTS

| | | |
|---|---|---|
| JP | H05-102691 A | 4/1993 |
| JP | H08-45362 A | 2/1996 |

(Continued)

OTHER PUBLICATIONS

International Preliminary Report on Patentability dated Apr. 26, 2018 issued in PCT/JP2015/079054.

(Continued)

*Primary Examiner* — Jean F Duverne

(74) *Attorney, Agent, or Firm* — Scully, Scott, Murphy & Presser, PC

(57) ABSTRACT

A connector for being arranged at an end of an electric wire includes a housing including an electric wire supporting portion in which an insertion hole to insert the electric wire thereinto is formed and which is harder than the electric wire and sandwiches the electric wire inserted into the insertion hole, and an annular magnetic core including a nanocrystalline soft magnetic material which is arranged around the electric wire supporting portion.

15 Claims, 5 Drawing Sheets

(51) Int. Cl.

| | |
|---|---|
| *H01R 11/12* | (2006.01) |
| *H01F 27/25* | (2006.01) |
| *H01B 7/00* | (2006.01) |

(56) References Cited

U.S. PATENT DOCUMENTS

| | | | | |
|---|---|---|---|---|
| 2007/0120635 | A1* | 5/2007 | Kobayashi | H01F 17/06 336/174 |
| 2008/0074336 | A1* | 3/2008 | Signorelli | G01V 3/28 343/719 |
| 2014/0182921 | A1 | 7/2014 | Imahori | |

FOREIGN PATENT DOCUMENTS

| | | | |
|---|---|---|---|
| JP | 2010-021571 | A | 1/2010 |
| JP | 2014-130708 | A | 7/2014 |

OTHER PUBLICATIONS

International Search Report dated Jan. 19, 2016 issued in PCT/JP2015/079054.

* cited by examiner

CONNECTOR AND WIRE HARNESS

TECHNICAL FIELD

The present invention relates to a connector and a wire harness.

BACKGROUND ART

A wire harness is known which is installed in, e.g., a vehicle having an electric motor as a driving source for connecting an inverter with the electric motor. As such type wire harness, a wire harness is known which is provided with a braided shield to reduce electromagnetic noise radiated from an electric wire of the wire harness.

JP 2014/130708 A discloses a wire harness that further reduces the electromagnetic noise radiated from the wire harness by installing a magnetic core such as a ferrite core in addition to the braided shield.

SUMMARY OF INVENTION

Technical Problem

However, the ferrite core used as the magnetic core in JP 2014/130708 A has a large size and a large mass. Thus, there is a problem that it is necessary to fix the ferrite core to a vehicle body etc., so that a degree of freedom in routing layout of the wire harness decreases.

Also, there are problems that a dedicated fixing member to fix the ferrite core to the vehicle body etc., is required, the number of parts increases, and workability in attaching the wire harness lowers.

It is an object of the invention to provide a connector and a wire harness that can improve the degree of freedom in the routing layout and reduce the number of parts while reducing the electromagnetic noise.

Solution to Problem

To solve the above problem, the present invention may provide a connector for being arranged at an end of an electric wire, comprising:

a housing comprising an electric wire supporting portion in which an insertion hole to insert the electric wire thereinto is formed and which is harder than the electric wire and sandwiches the electric wire inserted into the insertion hole; and an annular magnetic core comprising a nanocrystalline soft magnetic material which is arranged around the electric wire supporting portion.

Also, to solve the above problem, the present invention may provide a wire harness comprising the electric wire and the connector.

Advantageous Effects of Invention

According to the present invention, a connector and a wire harness can be provided that can improve the degree of freedom in the routing layout and reduce the number of parts while reducing the electromagnetic noise.

DESCRIPTION OF EMBODIMENTS

Embodiments

An embodiment of the invention will be described below in reference to the appended drawings.

(Explanation of Overall Structure of Wire Harness)

Figure 1A:
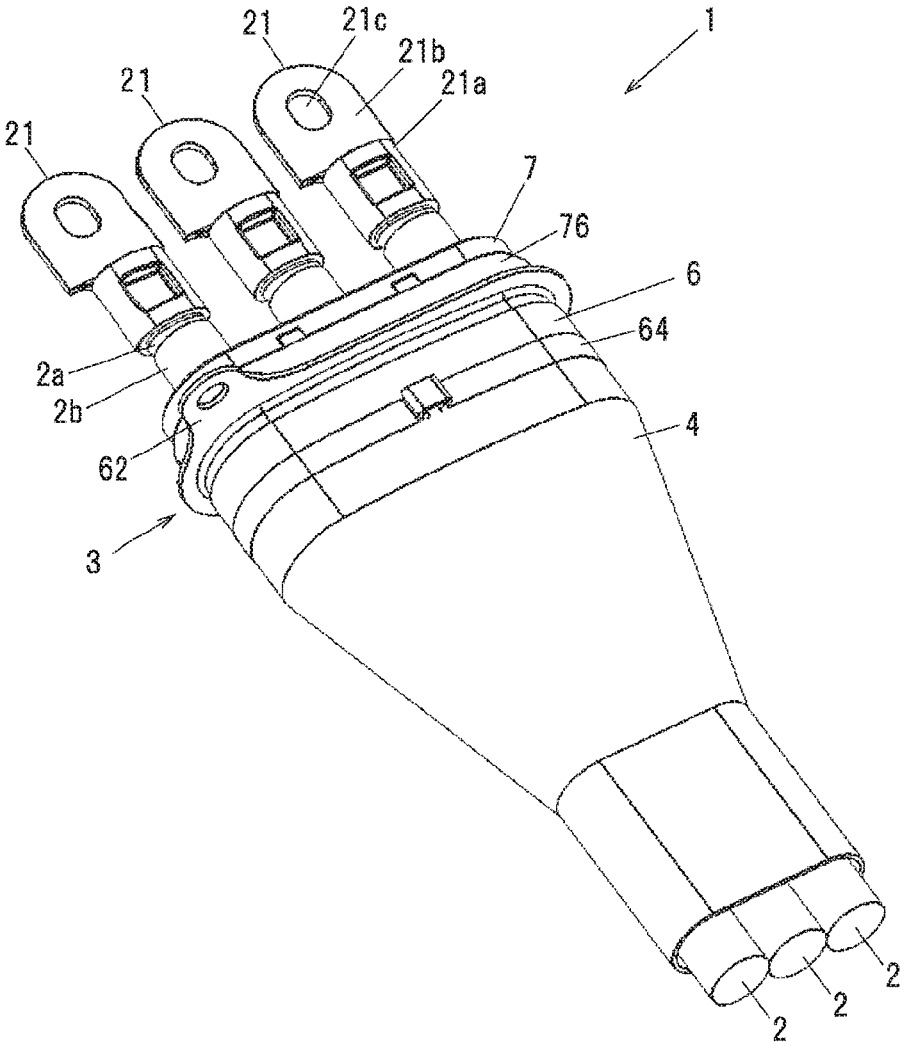
FIG. 1A is a perspective view showing an appearance of a wire harness according to the embodiment of the invention.
Figure 1B:
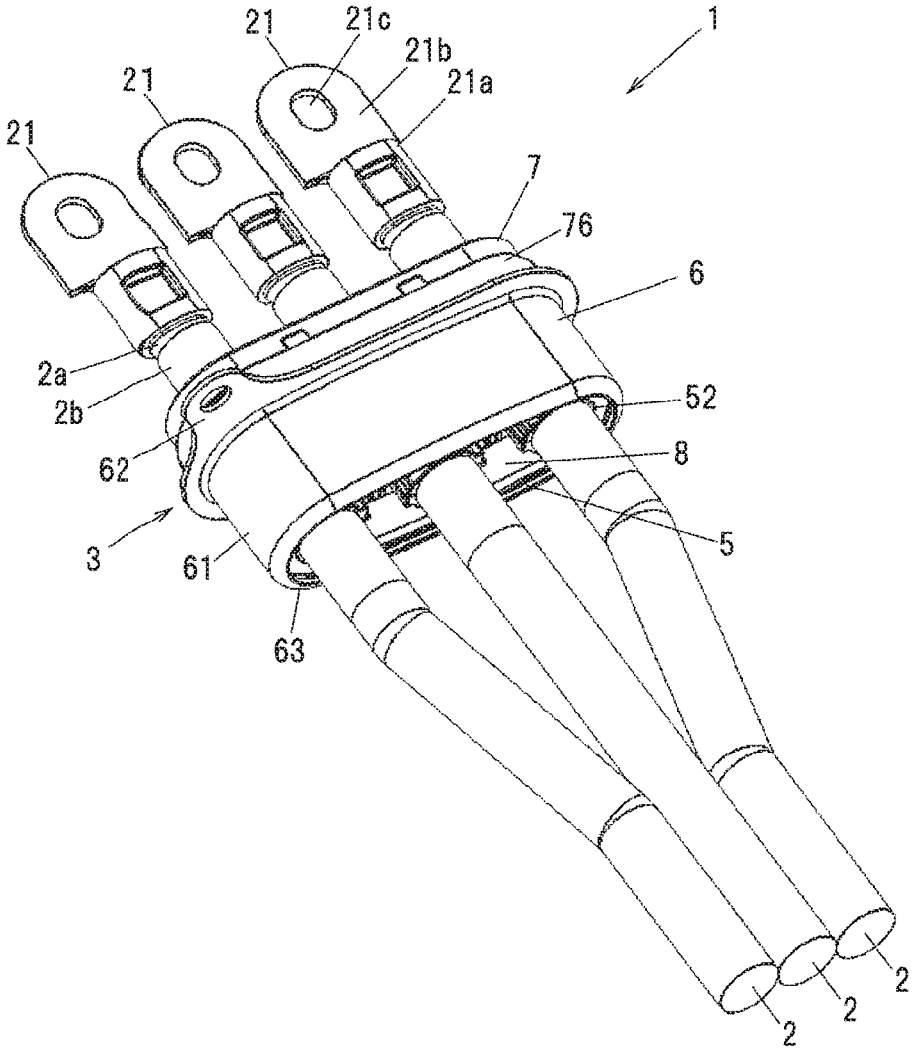
FIG. 1B is a perspective view of FIG. 1A omitting a braided shield.

FIG. 1A is a perspective view showing an appearance of a wire harness according to the embodiment of the invention. FIG. 1B is a perspective view of FIG. 1A omitting a braided shield.

As shown in FIGS. 1A and 1B, a wire harness 1 is provided with an electric wire 2 and a connector 3 provided at an end of the electric wire 2.

For example, the wire harness 1 is mounted on a vehicle driven by an electric motor such as an electric vehicle or a hybrid car, and is used to supply Pulse Width Modification (PWM) controlled current output from an inverter to the electric motor. The current includes a high-frequency component caused by switching a switching element such as a power transistor.

In the present embodiment, the wire harness 1 is configured to supply three phase alternating current of U phase, V phase, and W phase to the electric motor by using three electric wires 2.

Respective electric wires 2 are respectively provided with a conductor 2*a* formed by twisting a plurality of wires comprising an electric good conductor, and an insulator 2*b* comprising an insulating resin provided at an outer periphery of the conductor 2*a*.

Connection terminals 21 are connected to ends of respective electric wires 2. The connection terminal 21 is collectively provided with a swaging portion 21A that is swaged and fixed at the end of conductor 2*a*, and a tabular connecting portion 21B extended from the swaging portion 21*a*. A connecting hole 21*c* for fixing bolt penetrating the connecting portion 21B in the thickness direction is formed at the connecting portion 21*b*. The connection terminal 21 is electrically connected to a device side connection terminal by bolting the connection portion 21B to the corresponding device side connection terminal provided at a terminal block in a connection target device such as an inverter.

A braided shield 4 is provided around three electric wires so as to collectively cover the three electric wires 2. For example, the braided shield 4 is formed by braiding a plurality of shield wires comprising tin-plated copper. In such case, the braided shield 4 is configured by combining six shield wires as one wire bundle, crossing the wire bundles in X shape and braiding together. For example, the braided shield 4 can enlarge and contract an inner diameter by manually changing the size of braid.

As not shown, a corrugated tube to protect the electric wire 2 may be provided at an outer periphery of the braided shield 4. The corrugated tube is a tubular member comprising resin, and has a bellows shape in which a large diameter portion and a small diameter portion are alternately formed.

(Explanation of Connector 3)

Figure 2:
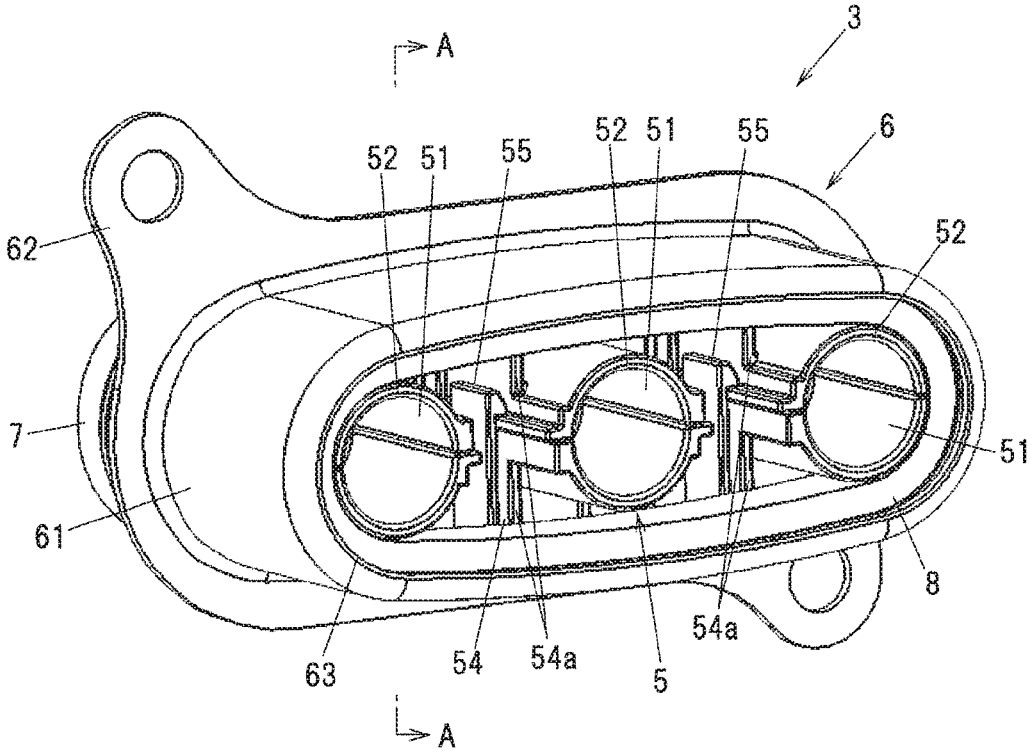
FIG. 2 is a perspective view showing a connector.
Figure 3:
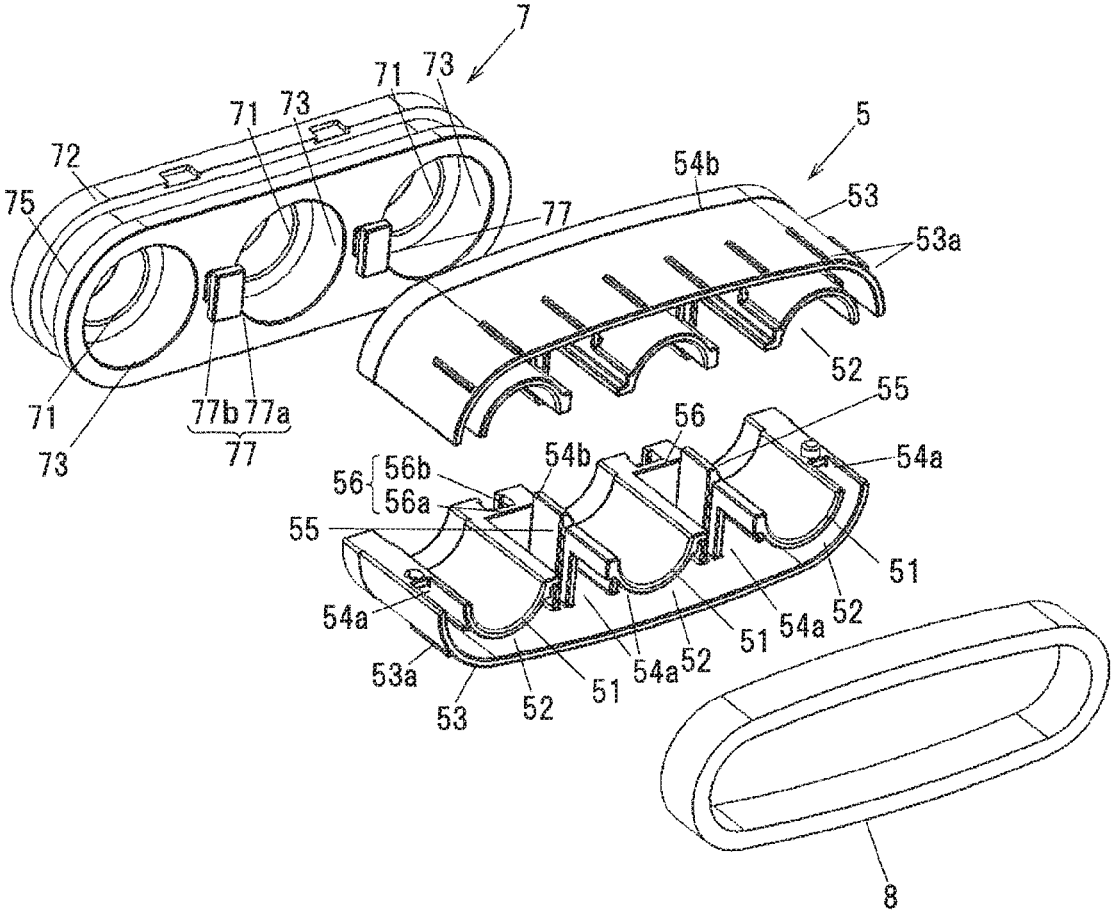
FIG. 3 is an exploded perspective view showing the connector.
Figure 4:
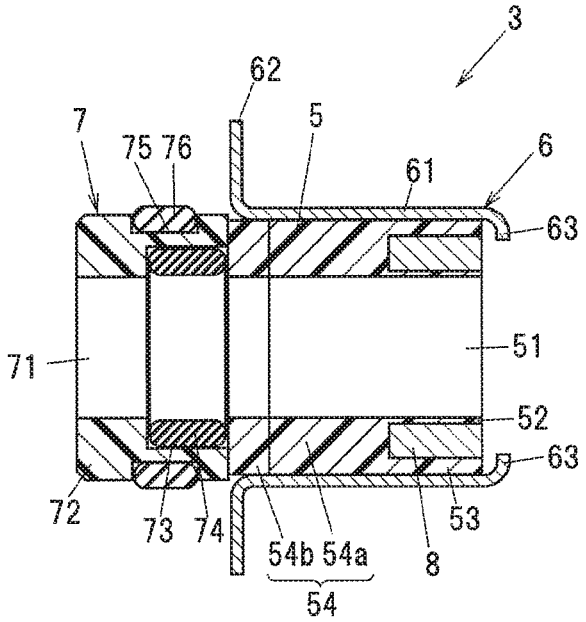
FIG. 4 is a cross sectional view of FIG. 2 cut along the line A-A.

FIG. 2 is a perspective view showing the connector 3. FIG. 3 is an exploded perspective view showing the connector 3. FIG. 4 is a cross sectional view of FIG. 2 cut along the line A-A.

As shown in FIGS. 2 to 4, the connector 3 is provided with a housing (an electric wire holder) 5 comprising insulating resin, a shield shell (a shield case) 6 comprising a conductive metal, and a seal holding member (a retainer) 7. The connector 3 is fixed to a body of the connection target device such as the inverter. The connector 3 holds the end of respective electric wires 2.

For the connector 3 according to the present embodiment, the housing 5 is configured to form an insertion hole 51 through which the electric wire 2 is inserted. The housing 5 is provided with an electric wire supporting portion 52 harder than the electric wire 2, which sandwiches the electric wire 2 inserted through the insertion hole 51. The housing 5 is configured to provide an annular magnetic core 8 comprising a nanocrystalline soft magnetic material around the electric wire supporting portion 52. That is, the connector 3 mounts the magnetic core 8. It should be noted that the term "hard" as used herein means that it is harder to bend when an electric wire having same length with the electric wire 2 (for example, length per unit) is bent while both ends are held.

The electric wire supporting portion 52 is formed in a cylindrical shape. Here, three electric wire supporting portions 52 are provided in accordance with the three electric wires 2. Meanwhile, it is not limited to thereof. For example, the electric wire supporting portion 52 may be provided with a collectively configured electric wire supporting portion having three insertion holes 51. The three electric wire supporting portions 52 are aligned and arranged in regular intervals in a perpendicular direction to the longitudinal direction of the electric wire 2. The three electric wire supporting portions 52 are configured to hold the three electric wires 2 in an aligned state. Hereinafter, the longitudinal direction of the electric wire 2 in the connector 3 is referred to as a length direction, an aligning direction of the electric wire 2 is referred to as a width direction, and a perpendicular direction to the length direction and the width direction is referred to as a height direction.

The magnetic core 8 is a magnetic core to reduce electromagnetic noises radiated from the wire harness 1. The magnetic core 8 is formed in an annular shape so as to collectively cover the three electric wire supporting portions 52. Meanwhile, a plurality of magnetic cores 8 may be configured to provide so as to individually cover the respective electric wire supporting portions 52, in such case, it is necessary to enlarge space between the respective electric wire supporting portions 52 such that the magnetic core 8 can be housed. Thus, enlarging the size of the connector 3 may be caused. That is, the structure contributes to downsizing the connector 3 by providing the magnetic core 8 so as to cover the plurality of electric wire supporting portions 52 collectively.

In the present embodiment, the magnetic core 8 comprises a nanocrystalline soft magnetic material. The nanocrystalline soft magnetic material is a material in which nanocrystalline particles in ferromagnetic phase are dispersed in a remaining amorphous phase by crystallizing an amorphous alloy.

Herein, Fine Met (registered trademark) is used as the nanocrystalline soft magnetic material. For example, the magnetic core 8 comprising Fine Met (registered trademark) is formed by heat treating and crystallizing amorphous metal ribbon at not less than a crystallizing temperature after formed into a magnetic core shape (in such case, an annular shape collectively covering three electric wire supporting portions 52), which is formed of a molten alloy that has Fe(—Si)—B as a basic constituent, and trace Cu and elements such as Nb, Ta, Mo, and Zr as additives so as to have a thickness of approximately 20 μm by a rapid quenching method such as a single role method. Crystal particle diameter in the magnetic core 8 is approximately 10 nm. Meanwhile, a nanocrystalline soft magnetic material except FINEMET (registered trade mark) such as NANOMET (registered trademark) may be used as the magnetic core 8.

The nanocrystalline soft magnetic material has high saturation magnetic flux density and excellent soft magnetic property (high magnetic permeability/low magnetic core loss property) as compared to conventionally used soft magnetic material such as soft ferrite. Thus, the magnetic core 8 can be downsized by using the nanocrystalline soft magnetic material as the magnetic core 8. As a result, even when the magnetic core 8 is housed in the connector 3, increasing the size of connector 3 can be controlled and the compact connector 3 can be obtained while housing the magnetic core 8. The size (thickness and length) of the magnetic material core 8 may be set suitably so as to obtain desired property while considering property in the nanocrystalline soft magnetic material to be used etc.

In addition, the nanocrystalline soft magnetic material has a property that electromagnetic wave noise in a frequency band used for radio such as amplitude modulation (AM) radio can be controlled compared to the conventionally used soft magnetic materials such as soft ferrite. For vehicle, since traffic information etc., is provided by the AM radio, the effect to control the electromagnetic wave noise in the frequency band used for the radio is great, where the wire harness is applied to vehicle especially.

Meanwhile, the nanocrystalline soft magnetic material has a property to change the magnetic property when stress is applied from outside. Therefore, when the magnetic core 8 comprising the nanocrystalline soft magnetic material is used, it is necessary to adopt a structure so as not to apply stress to the magnetic core 8 from outside.

Thus, in the present embodiment, the wire harness 1 is configured to provide the electric wire supporting portion 52 comprising a material harder than the electric wire 2 in the housing 5, and the annular magnetic core 8 comprising the nanocrystalline soft magnetic material around the electric wire supporting portion 52. Hereby, stress fails to be applied to the magnetic core 8 even when the electric wire 2 is bent, and it is possible to control change in the magnetic property in the magnetic core 8.

When the magnetic core 8 protrudes from the electric wire supporting portion 52 in the length direction (the longitudinal direction of the electric wire 2), the magnetic core 8 may change the magnetic property caused by interfering with the bent electric wire 2 at a protruded portion of the magnetic core 8. Thus, it is desirable that the magnetic core 8 is provided so as not to protrude in the longitudinal direction of the electric wire 2 from the electric wire supporting portion 52.

Further, since the distance between the magnetic core 8 and the electric wire 2 increases when the electric wire supporting portion 52 is formed thick, the electric wire 2 may not intersect with the magnetic core 8 even when the magnetic core 8 partly protrudes in the longitudinal direction (the longitudinal direction of the electric wire 2) from the electric wire supporting portion 52. Meanwhile, as the distance between the electric wire 2 and the magnetic core 8 increases, the circumferential length of the stacked magnetic cores 8 increases and the effect to control electromagnetic wave decreases. That is, the thickness of the electric wire supporting portion 52 can decrease additionally (the distance between the magnetic core 8 and the electric wire 2 can decrease additionally) by providing the magnetic core 8 so as not to protrude in the longitudinal direction of the electric wire 2 from the electric wire supporting portion 52 as with the present embodiment. Thus, it is possible to control change in the magnetic property in the magnetic core 8 while further enhancing the effect to control electromagnetic wave.

In the present embodiment, the housing 5 is further provided with a tubular outside wall portion 53 provided to cover the electric wire supporting portion 52 and the magnetic core 8 so as to sandwich the magnetic core 8 with the electric wire supporting portion 52, and a connecting portion 54 connecting the outside wall portion 53 with the electric wire supporting portion 52 at a tip end side of the electric wire 2 from the magnetic core 8 so as to sandwich the magnetic core 8 with the electric wire supporting portion 52.

The outside wall portion 53 is provided to be separated from the respective electric wire supporting portions 52 and collectively cover the respective electric wire supporting portions 52. The magnetic core 8 is arranged at a space between the outside wall portion 53 and the electric wire supporting portion 52. The outside wall portion 53 have combining functions to firmly fix the shield shell 6 to the housing 5 and control changing the magnetic property in the magnetic core 8 by controlling interposition to the magnetic core 8 from outside.

Further, in the present embodiment, although the electric wire supporting portion 52 arranged at a center in the width direction and the magnetic core 8 are provided so as to be separated, to hold the magnetic core 8 more firmly, the housing 5 may provide a protrusion protruding outward on the electric wire supporting portion 52 arranged at the center in the width direction and hold the magnetic core 8 between the protrusion and the outside wall portion 53.

The connecting portion 54 is provided with a rib-like connecting piece 54*a* respectively connecting a center portion and both side portions in the width direction of the electric wire supporting portion 52, and the outside wall portion 53, and a front wall portion 54*b* provided to close the space between the electric wire supporting portion 52 and the outside wall portion 53 at the tip end side of electric wire 2. The connecting piece 54*a* serves to regulate moving the magnetic core 8 toward the tip end side of the electric wire 2.

The electric wire supporting portion 52, the outside wall portion 53, and the connecting portion 54 are collectively formed and comprise the same material. That is, in the present embodiment, the entire housing 5 including the electric wire supporting portion 52, the outside wall portion 53, and the connecting portion 54 comprises the insulating resin material harder than the electric wire 2. However, the material is not limited to thereof, at least, the electric wire supporting portion 52 may comprise a material harder than the electric wire 2. The housing 5 comprises the insulating resins such as polybutylene terephthalate (PBT), polyamide (PA), and polyphenylene sulfide (PPS). For example, the housing 5 is molded by injection molding.

In addition, in the present embodiment, the housing 5 is divided in the vertical direction at a center portion in the height direction. The both divided housings 5 are configured to be fixed and integrated by fixing means including lance 55.

A shield shell 6 is provided at an outer periphery of the outside wall portion 53 by press fitting. The shield shell 6 comprises conductive metals such as iron, brass, and aluminum. The shield shell 6 is configured to house at least a part of the housing 5. A plurality of rib-like protrusions 53*a* formed along the length direction are formed at an electric wire insertion side end of the outer periphery of the outside wall portion 53 are formed separately. The press fitted shield shell is configured to fix on the housing 5 firmly by the protrusion portion 53*a*.

The shield shell 6 is provided with a tubular portion 61 provided to cover the periphery of outside wall portion 53 of the housing 5, and a flange portion 62 provided to protrude outside from a tip end of the tubular portion 61, which is fixed to a body of a connection target device such as an inverter. A belt-like fastening member 64 is provided at the outer periphery of the shield shell 6. The fastening member 64 fixes the braided shield 4 to the outer periphery of the shield shell 6. The tubular portion 61 is fastened and fixed in the housing 5.

In the present embodiment, a stopper portion 63 to regulate moving the magnetic core 8 toward the extending side of the electric wire 2, which is protruded inside, is formed at the extended side end of the shield shell 6 (the tubular portion 61). In such case, the stopper portion 63 is configured to control escaping the magnetic core 8 from the housing 5 by bending a base end of the tubular portion 61 inside. Meanwhile, it is not limited to thereof, for example, the stopper portion 63 may be configured by forming a plurality of protrusions protruding inside from an inner peripheral surface of the tubular portion 61.

The seal holding member 7 is provided with a seal holding housing 72 having three insertion holes 71 through which the electric wire 2 is inserted, an annular wire seal 74 arranged at a wire seal groove 73 formed along a circumferential direction at a housing 5 side end of the insertion hole 71, and an annular outer peripheral seal member 76 arranged at an outer peripheral seal member groove 75 formed along a circumferential direction on the outer periphery of the housing. In the exploded perspective view of FIG. 3, the wire seal 74 and the outer peripheral seal member 76 are omitted.

The wire seal 74 is interposed between the insulator 2*b* of the electric wire 2 and the seal holding housing 72. The wire seal 74 regulates entering moisture into the device such as an inverter through the electric wire 2. The outer peripheral seal member 76 is interposed between the seal holding housing 72 and the body of the device such as an inverter. The outer peripheral seal member 76 regulates entering moisture into the device such as an inverter from outside of the seal holding housing 72.

A locking protrusion 77 protruding toward the base end side is formed collectively at a base end portion of the seal holding housing 72. The locking protrusion 77 is collectively provided with a rectangular head portion 77*a*, and a shaft portion (a neck portion) 77*b* which connects the head portion 77*a* with the seal holding housing 72, and is formed into a rectangular shape having width and height smaller than the head portion 77*a*.

A locking groove 56 to lock the locking protrusion 77 is formed on the front wall portion 54*b* of the housing 5. The locking groove 56 is provided with a head housing portion 56*a* that houses the head portion 77*a* of the locking protrusion 77, and has width, height and length longer than these of the head portion 77*a*, and a shaft housing portion 56*b* having width and height longer than the shaft portion 77*b*, and length shorter than the shaft portion 77*b*. The head housing portion 56*a* is configured to open forward through the shaft housing portion 56*b*.

By housing the head portion 77*a* into the head housing portion 56*a*, housing the shaft portion 77*b* into the shaft housing portion 56*b*, and locking the locking protrusion 77 into the locking groove 56, the housing 5 and the seal holding member 7 can be configured to be available to relative move when the shield shell 6 is fixed to the body of the device such as an inverter. In the present embodiment, the seal holding member 7 is movable in the length direction, the width direction, and the height direction with respect to the housing 5. By such configuration, even if the shield shell 6 and the housing 5 rotate or incline due to torque in bending the electric wire 2 and bolt fixing the shield shell 6, the seal holding member 7 less follows the rotation or the inclination. For example, losing the waterproof function can be regulated caused by excessive crushing of only a part of the outer peripheral seal member 76.

(Operation and Effect of the Embodiment)

As described above, the connector 3 according to the present embodiment is provided with the housing 5 comprising the electric wire supporting portion 52 harder than the electric wire 2 sandwiching the electric wire 2 inserted into the insertion hole 51, in which the insertion hole 51 to insert the electric wire 2 is formed, and the annular magnetic core 8 comprising the nanocrystalline soft magnetic material, which is provided around the electric wire supporting portion 52.

By using the annular magnetic core 8 comprising the nanocrystalline soft magnetic material, the magnetic core 8 can be mounted on the connector 3 while the magnetic core 8 is downsized and the size of the connector 3 fails to be increased compared to a conventionally used ferrite core etc.

In addition, by configuring to provide the magnetic core 8 around the electric wire supporting portion 52 harder than the electric wire 2, stress fails to be applied to the magnetic core 8, for example, when the electric wire 2 is bent. Thus, changing the magnetic property in the magnetic core 8 can be controlled.

By housing the magnetic core 8 in the connector 3, since it is unnecessary to fix a magnetic core to vehicle body etc., as with a conventional case where a magnetic core comprising a ferrite core etc., is provided outside the connector 3, it is possible to improve degree of freedom in the routing layout of the wiring harness 1. In addition, since a dedicated fixing member to fix magnetic material cores such as a ferrite core to a vehicle body etc., is unnecessary, it is possible to control a number of parts, and to improve workability when attaching the wire harness 1.

That is, according to the present embodiment, the connector 3 and the wire harness 1 can be realized that can improve the degree of freedom in the routing layout and reduce the number of parts while controlling changing the magnetic property in the magnetic core 8 and surely reducing the electromagnetic noise.

SUMMARY OF THE EMBODIMENT

Next, technical ideas understood from the embodiment will be described below citing the reference numerals, etc., used for the embodiment. However, each reference numeral, etc., described below is not intended to limit the constituent elements in the claims to the members, etc., specifically described in the embodiment.

[1] A connector (3) for being arranged at an end of an electric wire (2), comprising:

a housing (5) comprising an electric wire supporting portion (52) in which an insertion hole (51) to insert the electric wire (2) thereinto is formed and which is harder than the electric wire (2) and sandwiches the electric wire (2) inserted into the insertion hole (51); and an annular magnetic core (8) comprising a nanocrystalline soft magnetic material which is arranged around the electric wire supporting portion (52).

[2] The connector (3) according to [1], wherein the magnetic core (8) is arranged so as not to protrude in a longitudinal direction of the electric wire (2) from the electric wire supporting portion (52).

[3] The connector (3) according to [1] or [2], wherein the housing (5) comprises:

a tubular outside wall portion (53) arranged to cover the electric wire supporting portion (52) and the magnetic core (8) so as to sandwich the magnetic core (8) between tubular outside wall portion (53) and the electric wire supporting portion (52); and a connecting portion (54) connecting the outside wall portion (53) with the electric wire supporting portion (52) at a tip end side of the electric wire (2) from the magnetic core (8).

[4] The connector (3) according to [3], comprising a tubular shield shell (6) arranged to cover a periphery of the outside wall portion (53), wherein a stopper portion (63) to prevent movement of the magnetic core (8) toward an extension direction side of the electric wire (2) by being protruded inside is formed at an end of the electric wire (2) extension direction side of the shield shell (6).

[5] The connector (5) according to any one of [1] to [4], wherein the housing (5) comprises a plurality of electric wire supporting portions (52) such that a plurality of electric wires (2) are supported by the plurality of electric wire supporting portions (52), and wherein the magnetic core (8) is arranged to collectively cover the plurality of electric wire supporting portions (52).

[6] A wire harness (1), comprising:

the electric wire (2); and the connector (3) according to any one of [1] to [5].

Although the embodiments of the invention have been described, the invention according to claims is not to be limited to the above-mentioned embodiment. It should be noted that all combinations of the features described in the embodiments are not necessary to solve the problem of the invention.

The invention can be appropriately modified and implemented without departing from the gist thereof.

For example, in the above-mentioned embodiment, although the magnetic core 8 is arranged in the space between the electric wire supporting portion 52 and the outside wall portion 53 of the housing 5, it is not limited to thereof. For example, the magnetic core 8 may be configured to be sandwiched between the electric wire supporting portion 52 and the tubular portion 61 of the shield shell 6. However, since the outside wall portion 53 fulfills the function to hold the press-fitted shield shell 6, it is desirable to arrange the magnetic core 8 between the electric wire supporting portion 52 and the outside wall portion 53 where the shield shell 6 is provided by press fitting.

In addition, although the present embodiment describes the case where the number of the electric wires 2 is three, the number of electric wires 2 is not limited to thereof. For example, the number of electric wires 2 may one, two, or not less than four.

REFERENCE SIGNS LIST

1 WIRE HARNESS
2 ELECTRIC WIRE
3 CONNECTOR
4 BRAIDED SHIELD
5 HOUSING
51 INSERTION HOLE
52 ELECTRIC WIRE SUPPORTING PORTION
53 OUTSIDE WALL PORTION
54 CONNECTING PORTION
6 SHIELD SHELL
7 SEAL HOLDING MEMBER
8 MAGNETIC CORE

The invention claimed is:

1. A connector for being arranged at an end of an electric wire, comprising:

a housing comprising an electric wire supporting portion and an outside wall portion provided around an outer periphery of the electric wire supporting portion, the electric wire supporting portion including an insertion hole to insert the electric wire thereinto and sandwiching the electric wire inserted into the insertion hole; and an annular magnetic core comprising a nanocrystalline soft magnetic material which is arranged in a space between the electric wire supporting portion and the outside wall portion.

2. The connector according to claim 1, wherein the magnetic core is arranged so as not to protrude in a longitudinal direction of the electric wire from the electric wire supporting portion.

3. The connector according to claim 1, wherein the outside wall portion comprises:

a tubular portion arranged to cover the electric wire supporting portion and the magnetic core so as to sandwich the magnetic core between the tubular portion and the electric wire supporting portion.

4. The connector according to claim 3, comprising a tubular shield shell arranged to cover a periphery of the outside wall portion, wherein a stopper portion to prevent movement of the magnetic core toward an extension direction side of the electric wire by being protruded inside is formed at an end of the electric wire extension direction side of the shield shell.

5. The connector according to claim 1, wherein the housing comprises a plurality of electric wire supporting portions such that a plurality of electric wires are supported by the plurality of electric wire supporting portions, and wherein the magnetic core is arranged to collectively cover the plurality of electric wire supporting portions.

6. A wire harness, comprising:

the electric wire; and the connector according to claim 1.

7. The connector according to claim 2, wherein the outside wall portion comprises:

a tubular portion arranged to cover the electric wire supporting portion and the magnetic core so as to sandwich the magnetic core between the tubular outside wall portion and the electric wire supporting portion; and a connecting portion connecting the outside wall portion with the electric wire supporting portion at a tip end side of the electric wire from the magnetic core.

8. The connector according to claim 2, wherein the housing comprises a plurality of electric wire supporting portions such that a plurality of electric wires are supported by the plurality of electric wire supporting portions, and wherein the magnetic core is arranged to collectively cover the plurality of electric wire supporting portions.

9. The connector according to claim 3, wherein the housing comprises a plurality of electric wire supporting portions such that a plurality of electric wires are supported by the plurality of electric wire supporting portions, and wherein the magnetic core is arranged to collectively cover the plurality of electric wire supporting portions.

10. The connector according to claim 4, wherein the housing comprises a plurality of electric wire supporting portions such that a plurality of electric wires are supported by the plurality of electric wire supporting portions, and wherein the magnetic core is arranged to collectively cover the plurality of electric wire supporting portions.

11. A wire harness, comprising:

the electric wire; and the connector according to claim 2.

12. A wire harness, comprising:

the electric wire; and the connector according to claim 3.

13. A wire harness, comprising:

the electric wire; and the connector according to claim 4.

14. A wire harness, comprising:

the electric wire; and the connector according to claim 5.

15. The connector according to claim 3, wherein the housing comprises a connecting portion connecting the outside wall portion with the electric wire supporting portion at a tip end side of the electric wire from the magnetic core.

* * * * *